US010893790B2

(12) United States Patent
Ashworth et al.

(10) Patent No.: US 10,893,790 B2
(45) Date of Patent: Jan. 19, 2021

(54) WAREWASHER WITH AIR ASSISTED PRESCRAPPING

(71) Applicant: ILLINOIS TOOL WORKS INC., Glenview, IL (US)

(72) Inventors: Thomas J. Ashworth, Troy, OH (US); Alexander R. Anim-Mensah, Centerville, OH (US); Mary E. Paulus, Sidney, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 436 days.

(21) Appl. No.: 15/597,862

(22) Filed: May 17, 2017

(65) Prior Publication Data

US 2017/0367556 A1 Dec. 28, 2017

Related U.S. Application Data

(60) Provisional application No. 62/353,812, filed on Jun. 23, 2016.

(51) Int. Cl.

| | |
|---|---|
| ***A47L 15/00*** | (2006.01) |
| ***A47L 15/42*** | (2006.01) |
| ***A47L 15/24*** | (2006.01) |

(52) U.S. Cl.

CPC ..... *A47L 15/241* (2013.01); *A47L 15/0021* (2013.01); *A47L 15/0076* (2013.01);
(Continued)

(58) Field of Classification Search

CPC .... A47L 15/10; A47L 15/241; A47L 15/0021; A47L 15/0076; A47L 15/4202;
(Continued)

(56) References Cited

U.S. PATENT DOCUMENTS 2,135,043 A 11/1938 Seman
2,802,475 A * 8/1957 Stine ..... A47L 15/247 134/60

(Continued)

FOREIGN PATENT DOCUMENTS

DE 4323816 1/1995
DE 19750265 5/1999

(Continued)

OTHER PUBLICATIONS

Fort, Ellen; "A California Chef's Dish-Pit Hack Could Help Restaurants Address the Drought," https://sf.eater.com/2015/4/20/8458465/air-compressor-dishes-john-cox-sierra-mar-drought, retrieved online on May 17, 2017, 3 pages.

*Primary Examiner* — Joseph L. Perrin
*Assistant Examiner* — Irina Graf
(74) *Attorney, Agent, or Firm* — Thompson Hine LLP

(57) ABSTRACT

A warewash machine for washing wares includes a chamber for receiving wares, the chamber having an inlet side, an outlet side, multiple spray zones between the inlet side and the outlet side, and a conveyor arrangement for moving wares along a conveyance path through the multiple spray zones in a ware travel direction. A prescrapping zone is located toward the inlet side of the chamber, the prescrapping zone having a blow-off system comprising a plurality of prescrapping nozzles and a compressed air feed line for delivering compressed air to the prescrapping nozzles.

15 Claims, 4 Drawing Sheets

(52) U.S. Cl.
CPC ..... *A47L 15/4202* (2013.01); *A47L 15/4225* (2013.01); *A47L 15/4278* (2013.01); *A47L 15/4293* (2013.01); *A47L 15/4295* (2013.01); *A47L 15/0047* (2013.01); *A47L 2301/04* (2013.01); *A47L 2301/08* (2013.01); *A47L 2401/04* (2013.01); *A47L 2401/20* (2013.01); *A47L 2401/28* (2013.01); *A47L 2501/12* (2013.01); *A47L 2501/24* (2013.01); *A47L 2501/36* (2013.01); *A47L 2601/03* (2013.01)

(58) Field of Classification Search
CPC ..... A47L 15/4278; A47L 15/4293; A47L 15/4295; A47L 2501/20; A47L 2501/12; A47L 2601/03
See application file for complete search history.

(56) References Cited

U.S. PATENT DOCUMENTS 3,738,465 A 6/1973 Ettinger, Jr.
4,014,356 A * 3/1977 Carieri ..... A47L 15/247 134/63
4,319,930 A * 3/1982 Yano ..... B08B 3/022 134/10
4,561,144 A * 12/1985 Marais ..... A47L 15/245 15/302
4,801,333 A 1/1989 Mosell
5,067,192 A * 11/1991 Guelfi ..... A47L 15/24 15/302
5,218,980 A 6/1993 Evans
5,588,901 A 12/1996 Rubey et al.
5,599,398 A 2/1997 Lenglen
5,657,878 A 8/1997 Austin
5,775,347 A * 7/1998 Hoover ..... A47L 15/241 134/104.3
6,343,611 B1 2/2002 El-Shoubary et al.
7,270,135 B2 9/2007 Virgilio et al.
7,367,134 B2 5/2008 Osvatic et al.
7,731,806 B2 6/2010 Hapke
7,887,643 B2 2/2011 Stelzer et al.
7,909,939 B2 3/2011 Brewer et al.
8,118,242 B2 2/2012 Clavelle
8,534,471 B2 9/2013 Wong et al.
9,375,126 B2 6/2016 Abdulfattah et al.
9,487,976 B2 11/2016 Ala et al.
9,567,783 B2 2/2017 Ala
2002/0083966 A1* 7/2002 Eiermann ..... A47L 15/0002 134/25.2
2006/0090775 A1* 5/2006 De Kuyper ..... A47L 15/0055 134/25.2
2009/0064445 A1* 3/2009 Arnold ..... A47L 15/241 15/306.1
2010/0043844 A1 2/2010 Han et al.
2011/0017234 A1* 1/2011 Lehmann ..... A47L 15/0057 134/10
2011/0017240 A1* 1/2011 Berner ..... A47L 15/0047 134/25.2
2011/0203616 A1* 8/2011 Berner ..... A47L 15/241 134/25.2
2013/0319460 A1 12/2013 Schneider
2014/0102485 A1* 4/2014 Abdulfattah ..... A47L 15/0094 134/25.2
2015/0101639 A1* 4/2015 Heppner ..... A47L 15/0026 134/18
2016/0324395 A1 11/2016 Cox et al.
2017/0367557 A1 12/2017 Anim-Mensah

FOREIGN PATENT DOCUMENTS

EP 3210518 8/2017
GB 2345840 7/2000
JP 6397132 * 4/1988 ..... A47L 15/0057
JP 11138440 A * 5/1999 ..... A47L 15/0057
KR 100824678 B1 4/2008
KR 101698692 B1 * 1/2017 ..... A47L 15/0057
WO WO-2013028392 A1 * 2/2013 ..... A47L 15/0057

* cited by examiner

WAREWASHER WITH AIR ASSISTED PRESCRAPPING

TECHNICAL FIELD

This application relates generally to warewashers such as those used in commercial applications such as cafeterias and restaurants and, more particularly, to systems and methods to utilize air for prescrapping operations in such warewashers.

BACKGROUND

Commercial warewashers commonly include a housing which defines one or more internal washing and rinsing zones for dishes, pots pans and other wares. In conveyor-type machines wares are moved through multiple different spray zones within the housing for cleaning (e.g., ASR, pre-wash, wash, post-wash (aka power rinse) and rinse zones). One or more of the zones include a tank in which liquid to be sprayed on wares is heated in order to achieve desired cleaning. In batch-type machines wares are typically manually moved into a generally stationary location within a chamber cleaning, and then manually removed from the machine upon completion of all operations/steps of the cleaning cycle.

Reduced water consumption is becoming more important in certain areas in view of the growing demands for water as well as an increase in the number of drought stricken areas.

It would be desirable to provide a warewasher system and method that reduces water consumption.

SUMMARY

By incorporating an air system for prescrapping into an existing warewash machine water savings are achieved.

In one aspect, a warewash machine for washing wares includes a chamber for receiving wares, the chamber having an inlet side, an outlet side, multiple spray zones between the inlet side and the outlet side, and a conveyor arrangement for moving wares along a conveyance path through the multiple spray zones in a ware travel direction. A prescrapping zone is located toward the inlet side of the chamber, the prescrapping zone having a blow-off system comprising a plurality of prescrapping nozzles and a compressed air feed line for delivering compressed air to the prescrapping nozzles.

In the foregoing aspect, the prescrapping zone may be located either (i) external of the chamber upstream of the inlet side of chamber relative to the ware travel direction or (ii) internal of the chamber downstream of the inlet side of the chamber and upstream of any liquid spray zones within the chamber.

In the foregoing aspect, the prescrapping nozzles are oriented to deliver air flow onto wares in the prescrapping zone so as to move at least some food soils off of the wares and into a soil collection system of the prescrapping zone.

For this purpose, the plurality of prescrapping nozzles may be arranged over the conveyance path and are oriented to deliver air downward onto wares, and the soil collection system is located beneath the conveyance path.

In one implementation, the soil collection system includes a collection compartment with walls that direct food soils toward a strainer, and a liquid spray system including a plurality of collection system nozzles for spraying liquid onto one or more of the walls to promote movement of the food soils toward the strainer.

The soil collection system may also include a compressed air delivery arrangement below the conveyance path to promote movement of the food soils toward the strainer. In such cases, the compressed air delivery arrangement feeds compressed air to (i) the collection system nozzles so that a combined liquid and air flow is output by the collection system nozzles and/or (ii) to a secondary set of nozzles below the conveyance path such that only air is output by the secondary set of nozzles.

The liquid spray system may include a liquid feed line connected to receive liquid from a tank of one the spray zones in the chamber via operation of a pump associated with a liquid recirculation system of the one spray zone.

A valve may be located along the liquid feed line between the pump and the soil collection system nozzles to selectively control whether liquid is delivered from the tank to the soil collection system nozzles when the pump is operated.

The liquid spray system may include a liquid feed line connected to receive liquid from a tank to which water from one or more of the spray zones is drained, and a pump to feed liquid from the tank to the collection system spray nozzles. The tank may be connected to a drain line that receives water drained from one or more of the spray zones of the warewash machine. The tank may include an overflow to a main drain outlet of the machine In one implementation of the foregoing aspect, delivery of compressed air to the prescrapping nozzles may be controlled automatically based upon (i) ware sensing, (ii) timing based on conveyor speed and/or (iii) timing based upon ware distance travelled.

In one implementation of the foregoing aspect, the delivery of compressed air to the prescrapping nozzles is controlled manually by an operator pressing a button when the wares are in the prescrapping zone or at a particular location in the prescrapping zone.

In one implementation of the foregoing aspect, the delivery of compressed air to the prescrapping nozzles is controlled automatically based upon one or more sensors to detect the presence or absence of wares in the prescrapping zone. In such cases, the delivery of compressed air to the prescrapping nozzles is started at substantially the same time as, or earlier than when wares enter the prescrapping zone and/or the delivery of compressed air to the prescrapping nozzles is stopped at substantially the same time as, or following some lag time after when wares exit the prescrapping zone.

In one implementation of the foregoing aspect, the machine includes: (i) a triggerable, automatic or manual, dwell mode of the conveyor arrangement to permit longer prescrapping for heavily soiled wares; and/or (ii) a conveyor speed adjust that can be triggered, automatically or manually, to increase speed or lower speed for shortened prescrapping time or longer prescrapping time respectively; and/or (iii) a ware soil detection system and an associated controller configured to increase or lower conveyor speed for wares in the prescrapping zone based upon detected ware soil; and/or (iv) a ware detection system and an associated controller configured to: (a) increase or lower conveyor speed for wares in the prescrapping zone and/or (b) increase or lower compressed air speed or flow, in either case, based upon ware material, ware type and/or ware size.

In another aspect, a warewash machine for washing wares includes a chamber for receiving wares, the chamber at least one spray zone for receiving wares and spraying liquid thereon during a cleaning cycle. A prescrapping zone is located external of the chamber and includes a ware support surface. The prescrapping zone includes a blow-off system with a plurality of prescrapping nozzles and a compressed air feed line for delivering compressed air to the prescrapping nozzles, wherein the prescrapping nozzles are oriented to deliver air flow onto wares in the prescrapping zone so as to move at least some food soils off of the wares and into a soil collection system of the prescrapping zone. The plurality of prescrapping nozzles are arranged over the ware support surface and are oriented to deliver air downward onto wares, and the soil collection system is located beneath the ware support surface.

In one implementation of the immediately preceding aspect, the soil collection system includes a collection compartment with walls that direct food soils toward a strainer, and a liquid spray system including a plurality of collection system nozzles for spraying liquid onto one or more of the walls to promote movement of the food soils toward the strainer.

The details of one or more embodiments are set forth in the accompanying drawings and the description below. Other features, objects, and advantages will be apparent from the description and drawings, and from the claims.

DETAILED DESCRIPTION

Figure 1:
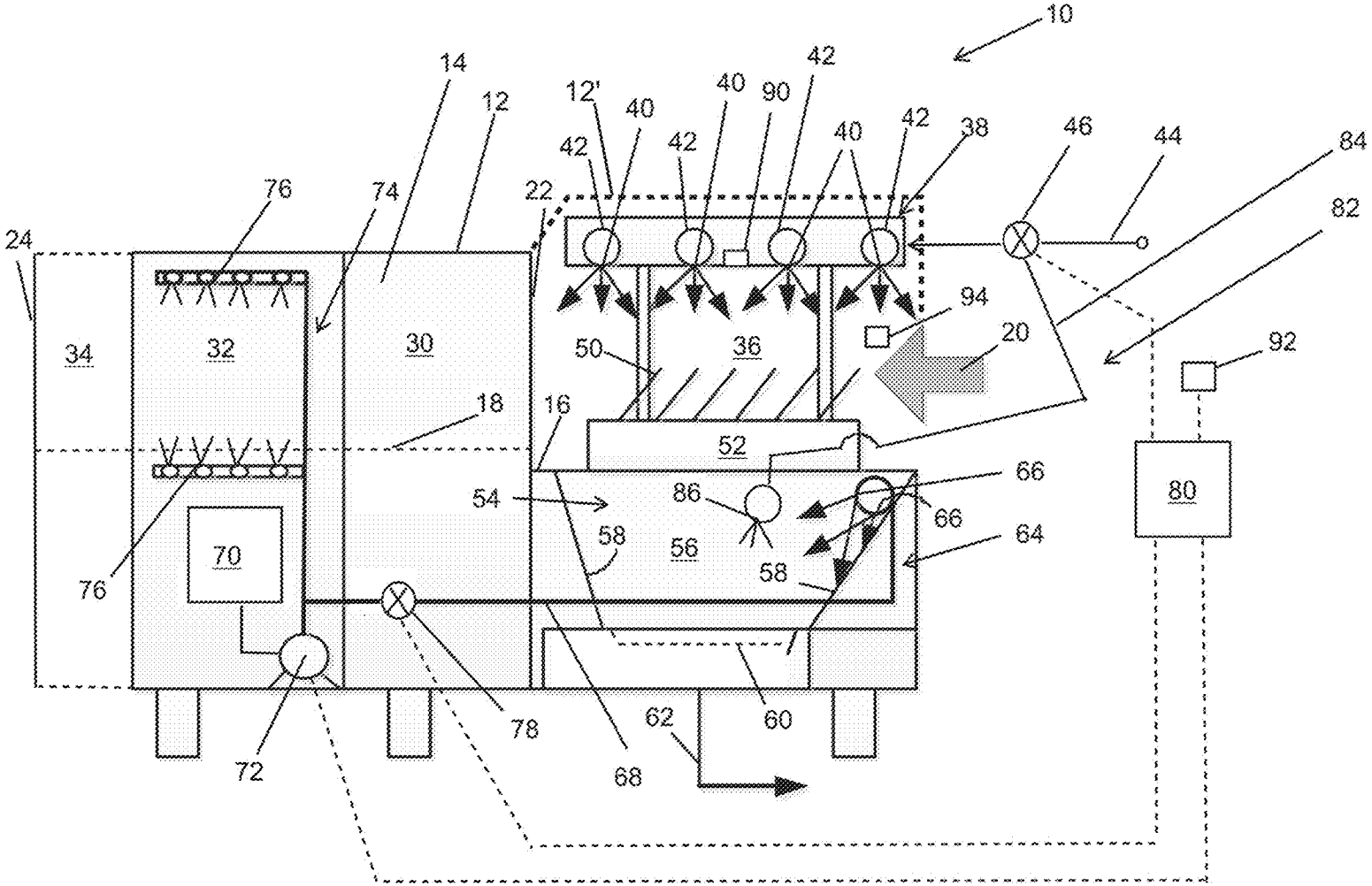
FIG. 1 is a schematic side elevation of one embodiment of a warewasher incorporating an air prescrapping zone.

Referring to FIG. 1, an exemplary warewash machine 10 is shown, with a housing 12 defining an internal chamber 14 that can receive wares for cleaning. The exemplary machine is of a conveyor-type that includes a conveyor arrangement 16 (e.g., continuous or reciprocating type) to feed wares along a conveyance path 18 in a ware travel direction 20 into an inlet side 22 of the chamber, through multiple spray zones within the chamber and to an outlet side 24 of the chamber. Here, the machine is shown with an automatic soil removal (ASR) system zone 30, a pre-wash zone 32, where additional zones such a wash zone (and possibly post-wash zone), rinse zone(s) and possibly a drying zone would be located in downstream segment 34 of the machine. The length of segment 34 of the machine housing can vary as suggested according to the number of zones incorporated into the machine. The machine also includes a prescrapping zone 36 located toward the inlet side of the chamber. Here the prescrapping zone 36 is located external of the chamber, adjacent the inlet side 22, but in other variations the prescrapping zone 36 could be a first zone within the chamber.

The prescrapping zone 36 includes a blow-off system 38 a plurality of prescrapping nozzles 40 and a compressed air feed line 44 for delivering compressed air to the nozzles. The nozzles 40 may be located in one or more air manifolds 42 that extend over the conveyance path of the wares, transverse to the conveyance direction 20. A valve 46 may be used to control compressed air flow to the nozzles. The compressed air feed line may be connected to an external source as a standalone unit, from the facility in which the machine is placed or from a compressor installed on the machine.

The prescrapping nozzles 40 are oriented to deliver air flow onto wares (e.g. wares 50 in rack 52) in the prescrapping zone 36 so as to move at least some food soils off of the wares and into a soil collection system 54 of the prescrapping zone. Here, the prescrapping nozzles 40 are arranged over the conveyance path of the wares and are oriented to deliver air downward onto wares as shown, and the soil collection system 54 is located beneath the conveyance path. Thus, the rack 52 may have a bottom support surface that is substantially open to permit food soils to pass downward therethrough, and the conveyor arrangement may be similarly open to allow the food soils to pass down into the soil collection system 54. The soil collection system 54 includes a collection compartment 56 with walls 58 that channel or otherwise direct food soils toward a strainer 60. The strainer may be a removable type (e.g., liftable upward out of the compartment 56 or retractable from a side of the compartment, such as in a drawer) to enable captured food soils to be carried by an operator to a disposal area without the food soils being sent down the drain path line 62. A liquid spray system 64 may also be provided as part of the soil collection system as shown. The system 64 includes a plurality of collection system nozzles 66 for spraying liquid onto one or more of the walls 58 to promote movement of the food soils toward the strainer so that the food soils do not stick to the walls and the walls. The liquid sprays may be directed along the wall surfaces for this purpose. Here, a liquid feed line 68 for the nozzles 66 is connected to receive liquid from a collection tank 70 of one of the spray zones (here pre-wash zone 32, though it could alternatively be a downstream spray zone) in the chamber 14 via operation of a pump 72 associated with a liquid recirculation system 74 of the one spray zone, where the liquid recirculation system feeds liquid to spray nozzles 76 (here both upper and lower nozzles) of the spray zone 32 and liquid falling under gravity moves back into the tank 70.

A valve 78 is located along the liquid feed line 68 between the pump and the soil collection system nozzles to selectively control whether liquid is delivered from the tank to the soil collection system nozzles when the pump is operated and/or the amount of flow along the feed line 68. Various factors may be used to control when the open/closed status of the valve and/or the flow area through the valve as described in more detail below. A controller 80 is configured for such purposes in automatic machines, and is shown here connected to pump 72 and valves 46 and 78, though connection of the controller 80 with other components of the machine (e.g., other pumps and valves, blowers, heaters, conveyor drive etc.) for control of such components would also exist. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group —including hardware or software that executes code), software, firmware and/or other components, or a combination of some or all of the above, that carries out the control functions of the machine or the control functions of any component thereof.

In some embodiments, the soil collection system may also include a compressed air delivery arrangement 82 below the conveyance path to promote movement of the food soils toward the strainer. For example, the compressed air delivery arrangement may feed compressed air to the collection system nozzles (e.g. via line 84 from valve 46) so that a combined liquid and air flow is output by the collection system nozzles and/or (ii) to a secondary set of nozzles 86 below the conveyance path such that only air is output by the secondary set of nozzles.

In some embodiments, in addition to compressed air being delivered to nozzles 40, some liquid could also be delivered to the nozzles 40 so that a combined liquid and air spray is used to move the food soils off of the wares. For example, feed line 68 could also be connected to deliver liquid to the nozzles 40.

In certain implementations, the controller 80 may be configure to control delivery of compressed air to the prescrapping nozzles 40 automatically based upon (i) ware sensing (e.g., from a ware sensor arrangement 90 that is connected to the controller 80), (ii) timing based on conveyor speed and/or (iii) timing based upon ware distance travelled. The delivery of compressed air to the prescrapping nozzles 40 may also be controlled manually by an operator pressing a button (e.g., mechanical or on a display) 92 when the wares are in a specific position of the prescrapping zone.

The controller 80 may be configure to control delivery of compressed air to the prescrapping nozzles automatically based upon one or more sensors 90 that detect the presence or absence of wares in a the prescrapping zone 36 or at a particular location of the prescrapping zone 36. The controller 80 may be configured such that delivery of compressed air to the prescrapping nozzles 40 is started at substantially the same time as or earlier than when wares enter the prescrapping zone 36. The controller 80 may also be configured such that delivery of compressed air to the prescrapping nozzles is stopped at substantially the same time as, or following some lag time after when wares exit the prescrapping zone 36.

The controller 80 may also be configured such that the machine 10 includes: (i) a triggerable, automatic or manual, dwell mode of the conveyor arrangement to permit longer prescrapping for heavily soiled wares, and/or (ii) a conveyor speed adjust feature that can be triggered, automatically or manually, to increase speed or lower speed for shortened prescrapping time or longer prescrapping time respectively, and/or (iii) the controller configured to increase or lower conveyor speed for wares in the prescrapping zone based upon detected ware soil as detected by a ware soil detection system (e.g., 94), and/or (iv) the controller configured to: (a) increase or lower conveyor speed for wares in the prescrapping zone and/or (b) increase or lower compressed air speed or flow, in either case, based upon ware material, ware type and/or ware size as detected by the ware detection system 90.

Other machine variations are possible, as described below.

Figure 2:
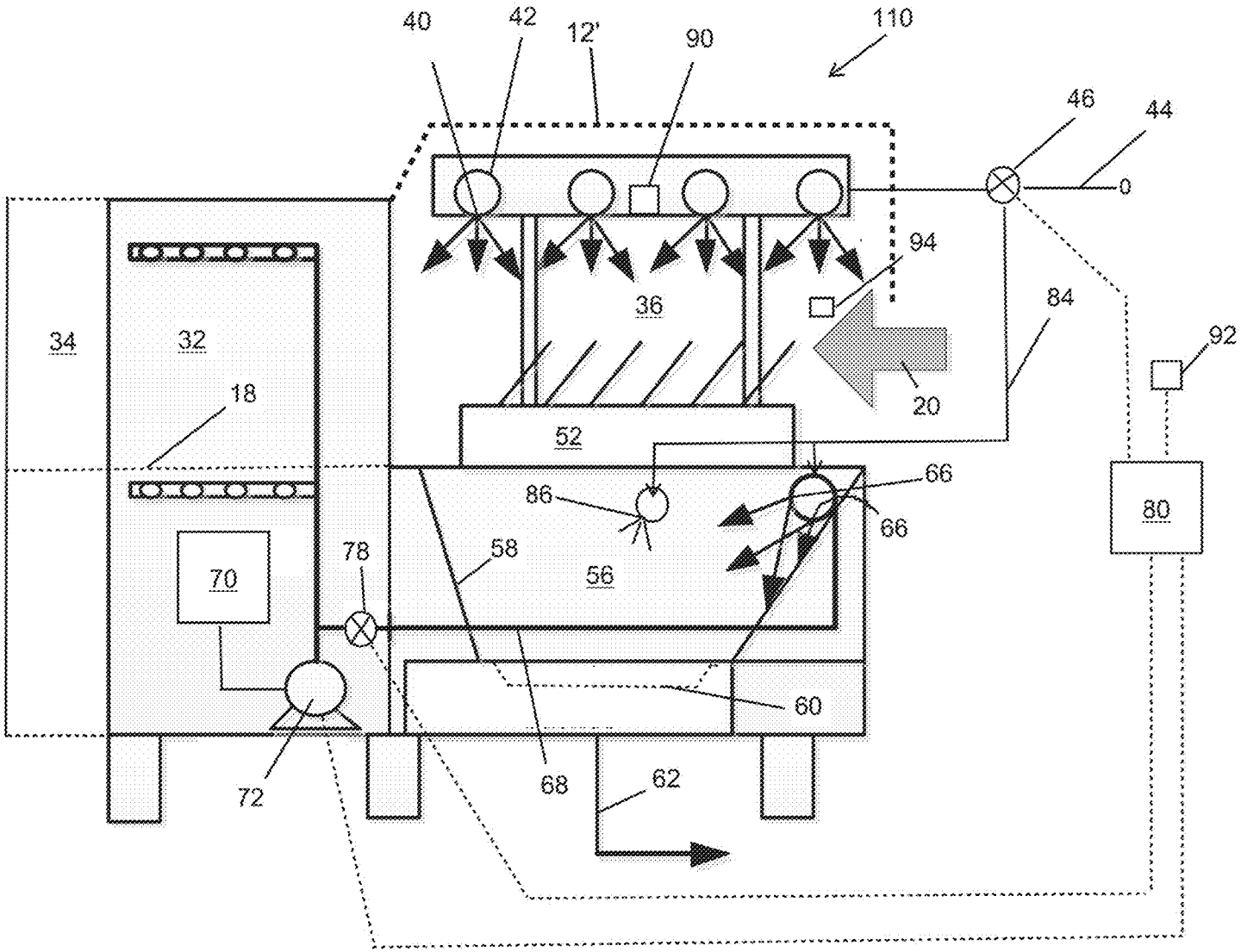
FIG. 2 is another schematic side elevation of one embodiment of a warewasher incorporating an air prescrapping zone.

Referring to FIG. 2, a machine 110 similar to machine 10 is shown, with like parts shown with like numerals. The primary difference between machine 110 and machine 10 is that in machine 110 the ASR zone 30 has been eliminated. Thus, in some cases the incorporation of the prescrapping zone with air blowoff will enable the machine to perform properly even without the ASR zone.

Figure 3:
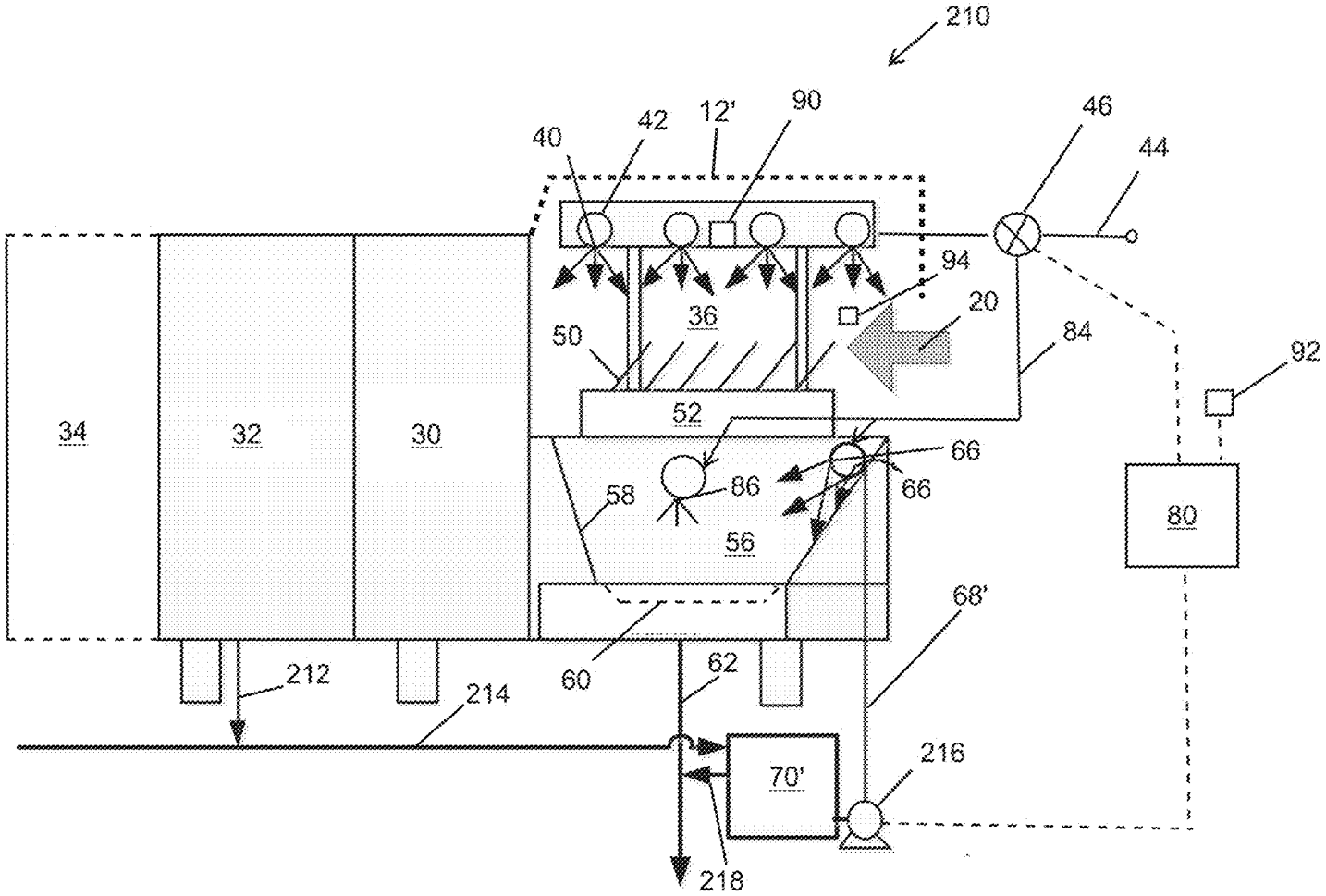
FIG. 3 is another schematic side elevation of one embodiment of a warewasher incorporating an air prescrapping zone.

Referring to FIG. 3, a machine 210 similar to machine 10 is shown, with like parts shown with like numerals. The primary difference between machine 210 and machine 10 is that the liquid feed line 68' of the liquid spray system is connected to receive liquid from a tank 70' to which water from one or more of the spray zones is drained (e.g., per drain path 212 to main drain line 214), and a separate pump 216 to feed liquid from the tank 70' to the collection system spray nozzles 66 is provided. The tank 70' includes an overflow 218 to the drain path line 62.

Figure 4:
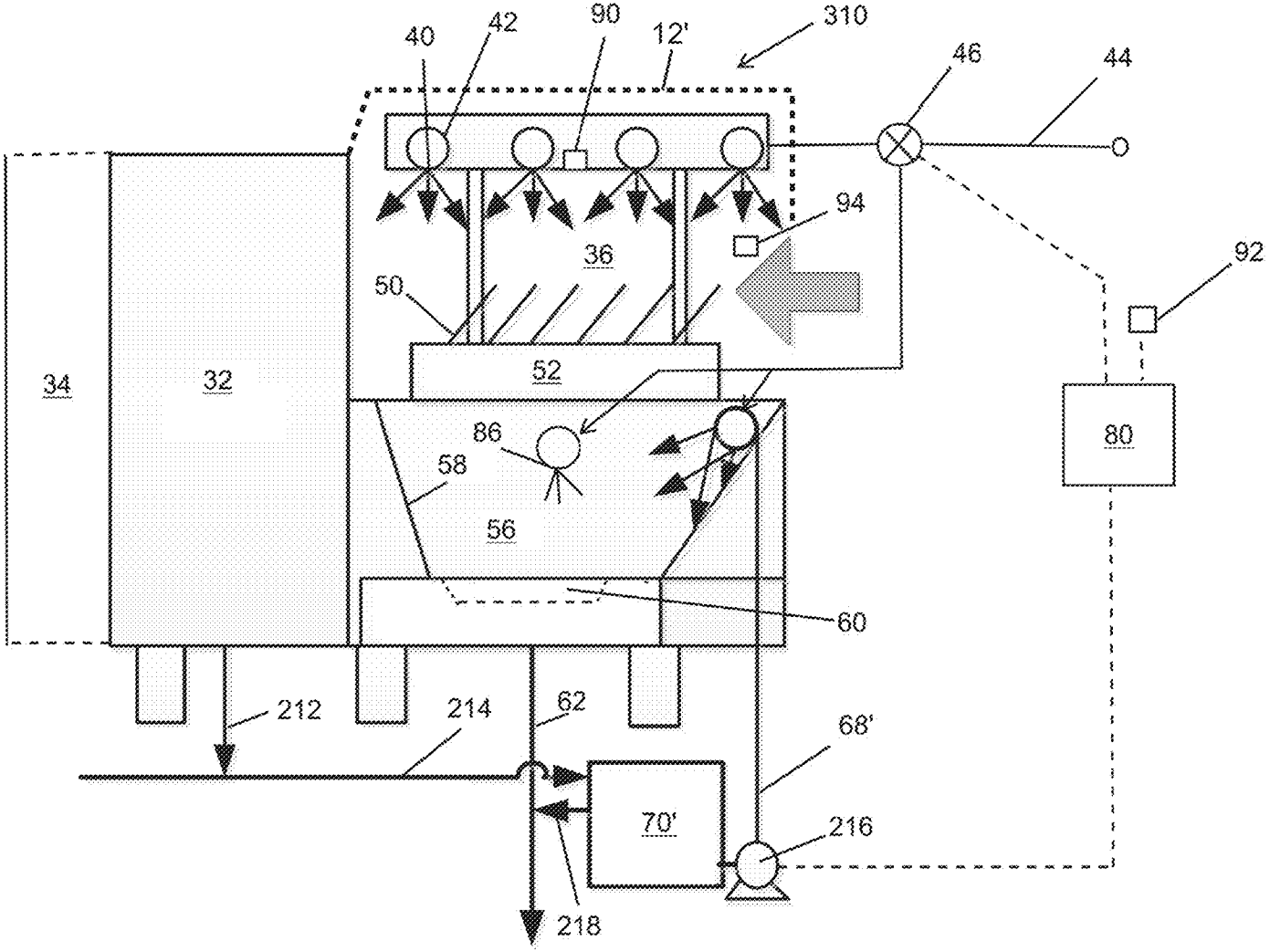
FIG. 4 is another schematic side elevation of one embodiment of a warewasher incorporating an air prescrapping zone.

Referring to FIG. 4, a machine 310 similar to machine 210 is shown, with like parts shown with like numerals. The primary difference between machine 310 and machine 210 is that in machine 310 the ASR zone 30 has been eliminated. Thus, in some cases the incorporation of the prescrapping zone with air blowoff will enable the machine to perform properly even without the ASR zone.

In connection with the machines 110, 210 and 310, the controller 80 may be configured similar to that of machine 10 in terms of how and when flows the prescrapping zone 36 are turned ON/OFF or otherwise varied, and in terms of how the conveyor is controlled.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application. While conveyor-type machines are primarily described, it is recognized that batch-type machines with a similar prescrapping zone and associated soil collection system are possible, but without the ware conveying features. Moreover, as mentioned above, the prescrapping zone may alternatively be located internal of machine chamber, in which case the machine may include an additional housing portion 12' shown in dashed line form in each of FIGS. 1-4.

What is claimed is:

1. A warewash machine for washing wares, comprising:

a chamber for receiving wares, the chamber having an inlet, an outlet, multiple spray zones between the inlet and the outlet, and a conveyor arrangement for moving wares along a conveyance path through the multiple spray zones in a ware travel direction;

wherein the multiple spray zones include a pre-wash spray zone with a plurality of spray nozzles, a liquid collection tank below the conveyor arrangement for collecting sprayed liquid that falls within the pre-wash spray zone, and a pump connected to recirculate liquid from the liquid collection tank back to the plurality of spray nozzles;

a prescrapping zone located upstream of the pre-wash spray zone relative to the ware travel direction and adjacent the inlet, wherein the prescrapping zone includes a blow-off system including a plurality of prescrapping nozzles above the conveyance path, wherein the prescrapping zone includes a soil collection system below the conveyance path;

wherein the blow-off system further comprises a compressed air feed line for delivering compressed air to the prescrapping nozzles, wherein the prescrapping nozzles are oriented to deliver air downward toward the conveyance path for moving food soils off of wares and down into the soil collection system;

wherein the soil collection system comprises a collection compartment below the conveyance path, wherein the collection compartment includes walls configured to direct food soils toward a strainer below the conveyance path, wherein the soil collection system further includes a liquid spray system including a plurality of soil collection system spray nozzles below the conveyance path and oriented for spraying liquid onto one or more of the walls to promote movement of the food soils toward the strainer.

2. The warewash machine of claim 1 wherein:

the prescrapping zone is located internal of the chamber downstream of the inlet of the chamber.

3. The warewash machine of claim 1 wherein the soil collection system further comprises a compressed air delivery arrangement below the conveyance path to promote movement of the food soils toward the strainer.

4. The warewash machine of claim 3 wherein the compressed air delivery arrangement feeds compressed air to the soil collection system spray nozzles so that a combined liquid and air flow is output by the soil collection system spray nozzles.

5. The warewash machine of claim 1 wherein the liquid spray system includes a liquid feed line connected to receive liquid from the liquid collection tank.

6. The warewash machine of claim 5 wherein a valve is located along the liquid feed line between the pump and the soil collection system spray nozzles to selectively control whether liquid is delivered from the liquid collection tank to the soil collection system spray nozzles when the pump is operated.

7. The warewash machine of claim 5 wherein the soil collection system further comprises a drain line that receives liquid that flows through the strainer.

8. The warewash machine of claim 1, further comprising a controller, a valve along the compressed air feed line, and at least one sensor located to detect the presence or absence of wares in the prescrapping zone, wherein the controller is connected to control the valve and is connected to the at least one sensor, wherein the controller is configured to control the valve such that delivery of compressed air to the prescrapping nozzles is controlled automatically based upon whether the at least one sensor detects the presence or absence of wares in the prescrapping zone.

9. The warewash machine of claim 8 wherein the controller is configured to control the valve such that delivery of compressed air to the prescrapping nozzles is started when wares enter the prescrapping zone.

10. The warewash machine of claim 9 wherein the controller is configured to control the valve such that delivery of compressed air to the prescrapping nozzles is stopped when wares exit the prescrapping zone.

11. The warewash machine of claim 1 wherein the machine includes:

a ware detection system and an associated controller, wherein the controller is connected to control the conveyor arrangement and the blow-off system, where the controller is configured to increase or lower conveyor speed for wares in the prescrapping zone based upon at least one of ware material, ware type or ware size as detected by the ware detection system.

12. The warewash system of claim 1, wherein a liquid feed line is connected to feed liquid to the plurality of prescrapping nozzles so that a combined liquid and air spray is output by the plurality of prescrapping nozzles to move the food soils off the wares.

13. A warewash machine for washing wares, comprising:

a chamber for receiving wares, the chamber including multiple spray zones for receiving wares and spraying liquid thereon during cleaning;

a conveyor passing through the chamber for carrying wares through the chamber in a ware travel direction during cleaning;

wherein the multiple spray zones include a first spray zone with a plurality of spray nozzles, a liquid collection tank below the conveyor for collecting sprayed liquid that falls within the first spray zone, and a pump connected to recirculate liquid from the liquid collection tank back to the plurality of spray nozzles;

a prescrapping zone internal of the chamber and upstream of the first spray zone relative to the ware travel direction, the prescrapping zone including a blow-off system and a soil collection system, the blow-off system comprising a plurality of prescrapping nozzles above the conveyor and a compressed air feed line for delivering compressed air to the prescrapping nozzles, wherein the prescrapping nozzles are oriented to deliver air flow down onto wares on the conveyor in the prescrapping zone so as to move at least some food soils off of the wares and into the soil collection system, wherein the soil collection system is located beneath the conveyor;

wherein the soil collection system comprises a collection compartment with walls that direct food soils toward a strainer, and a liquid spray system including a plurality of collection system nozzles oriented for spraying liquid onto one or more of the walls to promote movement of the food soils toward the strainer.

14. The warewash system of claim 13, wherein a liquid feed line is connected to feed liquid to the plurality of prescrapping nozzles so that a combined liquid and air spray is used to move the food soils off the wares.

15. The warewash system of claim 13 wherein:

a liquid feed line is connected to feed liquid to the plurality of prescrapping nozzles so that a combined liquid and air spray is used to move the food soils off the wares; and another compressed air feed line is connected to feed compressed air to the collection system nozzles so that a combined liquid and air flow is output by the collection system nozzles.

* * * * *